US006984195B1

(12) United States Patent
Phillips

(10) Patent No.: US 6,984,195 B1
(45) Date of Patent: Jan. 10, 2006

(54) SLIDING EXERCISE APPARATUS AND RECREATIONAL DEVICE

(76) Inventor: Forrest B. Phillips, P.O. 3682, Napa, CA (US) 94558

( * ) Notice: Subject to any disclaimer, the term of this patent is extended or adjusted under 35 U.S.C. 154(b) by 436 days.

(21) Appl. No.: 09/637,266

(22) Filed: Aug. 10, 2000

(51) Int. Cl.
*A63B 21/00* (2006.01)

(52) U.S. Cl. ..... 482/71; 482/72; 482/51

(58) Field of Classification Search ..... 482/72, 482/71, 51, 148
See application file for complete search history.

(56) References Cited

U.S. PATENT DOCUMENTS 4,180,260 A * 12/1979 Slagle ..... 482/72
5,326,338 A * 7/1994 Makous ..... 482/51
5,509,871 A * 4/1996 Giovanni ..... 482/51
5,593,370 A * 1/1997 Mumford et al. ..... 482/51

FOREIGN PATENT DOCUMENTS

DE 2654898 A1 * 3/1978

* cited by examiner

*Primary Examiner*—Jerome W. Donnelly
(74) *Attorney, Agent, or Firm*—Donald Diamond

(57) ABSTRACT

An apparatus for sliding exercise and recreation, such as a sports board including stick-on sheeting having an adhesive outer layer adhered to a substrate such as the underside of a sport board, and an opposed layer consisting of a low-friction, durable material adapted for engaging in sliding contact with the low-friction surface of area sheeting superposed on a support structure.

3 Claims, 5 Drawing Sheets

SLIDING EXERCISE APPARATUS AND RECREATIONAL DEVICE

BACKGROUND OF THE INVENTION

1. Field of the Invention

The present invention relates to apparatuses and methods for exercise and recreation providing sliding motion, and more specifically to sheeting having a low-friction, durable surface which provides a top surface for structures such as ramps, trampolines and gym mats, and which also is adhesively applied to sports equipment, such as snow boards and gym shoes, for contacting such top surfaces.

2. Description of the Related Art

Virtually all board sport and ski enthusiasts face the problem of how to maximize practice, skill development and exercise during times of the year when use of such equipment is not feasible. For example, snow boarders find that after a full winter season their skills are enhanced, but after the spring, summer and fall months of inactivity, board skills must be redeveloped and tuned once winter conditions provide an appropriate backdrop for practicing the sport.

Not only do winter sport enthusiasts face the grim prospect of having to go long periods between board usage, others such as surfers face similar constraints. Obviously, a surfer can only effectively use a surf board when access to a beach is available. But there are times when the surfer must travel inland and away from major bodies of water, preventing board usage.

Even when development of board skills is not the focus of such recreational activity, a board sport enthusiast may wish access to sliding surfaces for sheer recreation. For example, it is contemplated that there is an unsatisfied need to develop both permanent and temporary recreational systems which include ramps, jumps, chutes and slides so that both children and adults can experience the thrill of traversing an inclined low-friction, durable surface. The present invention can meet this need by quickly and inexpensively modifying an existing season-specific facility to transform it into a year-round, all-weather recreational and skill-enhancing facility. One example is modifying waterslides such as are commonly found in amusement parks featuring water-type recreation. In a conventional waterslide, water is applied to the surface of an inclined chute, typically made of fiberglass and concavely arcuate and bounded by upturned edges, to create an aqueous, low-friction film on which a user slides. Because water is required, such a device is inappropriate for indoor use, and outdoor use during cold weather. Moreover, some amusement park visitors are deterred from going on waterslides because they choose not to get their clothes wet.

My U.S. Pat. No. 6,231,483 B1 ("'483"), which is incorporated by reference herein in its entirety, is directed to a sliding exercise and recreational apparatus including a sport board housed within a carrying case. The case bottom has a low-friction surface which facilitates sliding the apparatus over a contact area. The case top has a removable portion to enable a user to access the board while it is housed within the case so that the user can be supported on the board and navigate the contact area without removing the board from the case.

German published application DE 2654898 discloses a backing strip made of aluminum foil, synthetic fiber or paper. One side of the strip is coated with an adhesive and covered with a protective film. The other side is coated with a wax layer which provides a low-friction running surface for a ski when, after removing the film, the strip is adhesively applied to the underside of the ski.

It is a principal object of the present invention to provide a simple and effective yet low cost expedient which can be applied to sport boards, runners, shoes and the like, as well as to surfaces upon which their undersides are intended to slide, and which is usable under all climatic conditions.

Another object of the invention to provide a recreational device which would enable a user to slide along a downwardly inclined support surface without the need for the use of a sport board or a liquid interface to reduce friction.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

In one aspect the invention provides an a sliding exercise apparatus and recreational device including a sports hoard having a top for contacting a user and a bottom, for sliding along a support surface, to which is adhered an adhesive layer of stick-on sheeting. The stick-on sheeting includes a low-friction, durable layer for engaging in sliding contact the support surface. Applied to the support surface is low-friction, durable sheeting for contacting the stick-on sheeting.

In another aspect the invention provides a sliding exercise apparatus and recreational device including the combination of a sports board and a support surface. The board has a bottom to which is adhered an adhering layer of a stick-on sheeting. The stick-on sheeting has a low-friction, durable layer for engaging in sliding contact low-friction, durable sheeting supported by and in contact with the support with the support surface.

A more complete understanding of the present invention and other objects, aspects and advantages thereof will be gained from a consideration of the following description of the preferred embodiments read in conjunction with the accompanying drawings provided herein.

DETAILED DESCRIPTION OF THE PREFERRED EMBODIMENTS

Figure 1:
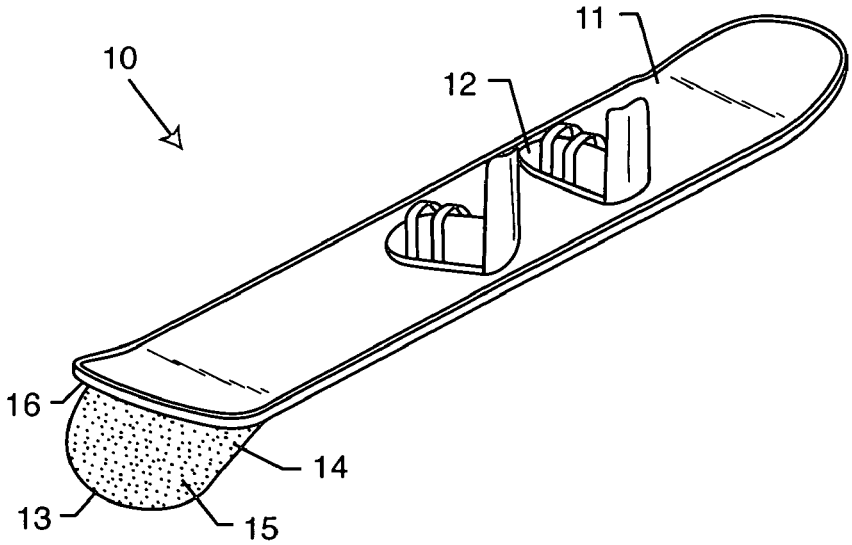
FIG. 1 is a perspective view of a typical sport board, here a snow board, to whose underside is attached a piece of stick-on sheeting, so that the board can be used in practicing the present invention.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

FIG. 1 shows a snow board 10 which has been modified for practicing the present invention. Board 10 has a top side 11 to which are attached supporting bindings 12, and an underside 16 to which is attached a piece 13 of low-friction, durable stick-on sheeting. Sheeting piece 13 includes an adhesive layer 15 which can be provided with a removable backing (not shown) which is peeled from layer 15 prior to use. Preferably the adhesive is selected so that sheeting piece 13 is easily removable from underside 16. Alternatively, the adhesive is such that piece 13 is permanently adhered to underside 16. Sheeting piece 13 further includes a low-friction, durable layer 14 opposed to layer 15. Preferably, layer 14 consists essentially of NYLON™, DACRON™, TEXLON™, sailcloth or a polyester resin. Sheeting piece 13 can be cut to size and shape to fit over the entire underside 16 of board 10. Alternatively, several smaller pieces of sheeting can be selectively placed to create areas of relatively low- and high-friction enabling a skillful user to control the board's sliding characteristics while traversing the low-friction, durable surface of a support structure such as shown in FIGS. 3, 5, 6, 7 and 8.

Figure 2A:
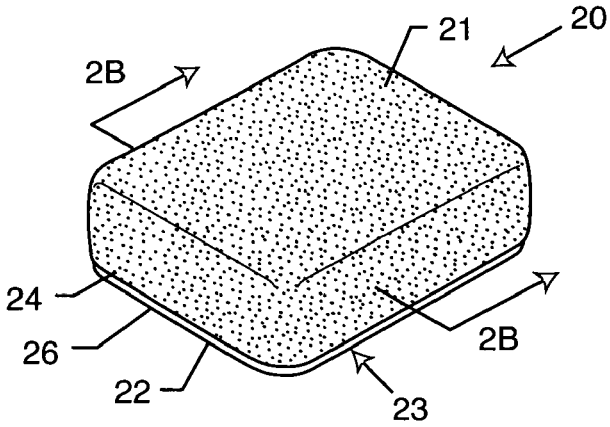
FIGS. 2A and 2B are perspective and cross-sectional views, respectively, of a typical sport board fabricated for practicing the invention.
Figure 2B:
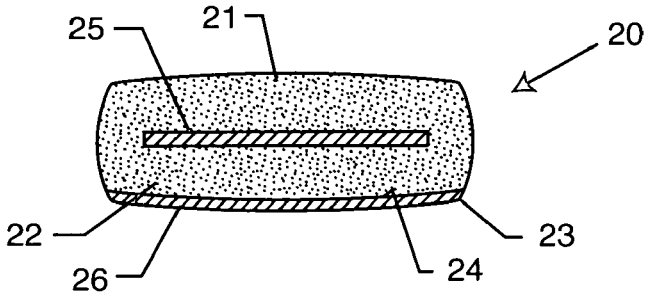

Besides being able to adapt conventional sport boards to practice the present invention, dedicated boards are feasible. FIGS. 2A and 2B show a typical rectangular board 20 having a cushioned top side 21 and an underside 22 composed of a plurality of cushioning layers made of a material such as STYROFOAM™. To add structural rigidity, top side 21 and underside 22 sandwich a rigid core 25 made of a material such as plywood. Board 20 further includes a piece 23 of stick-on sheeting having an adhesive layer 24 attached to underside 22, and an opposed low-friction, durable layer 26. Preferably, piece 23 is permanently adhered to underside 22.

Figure 3:
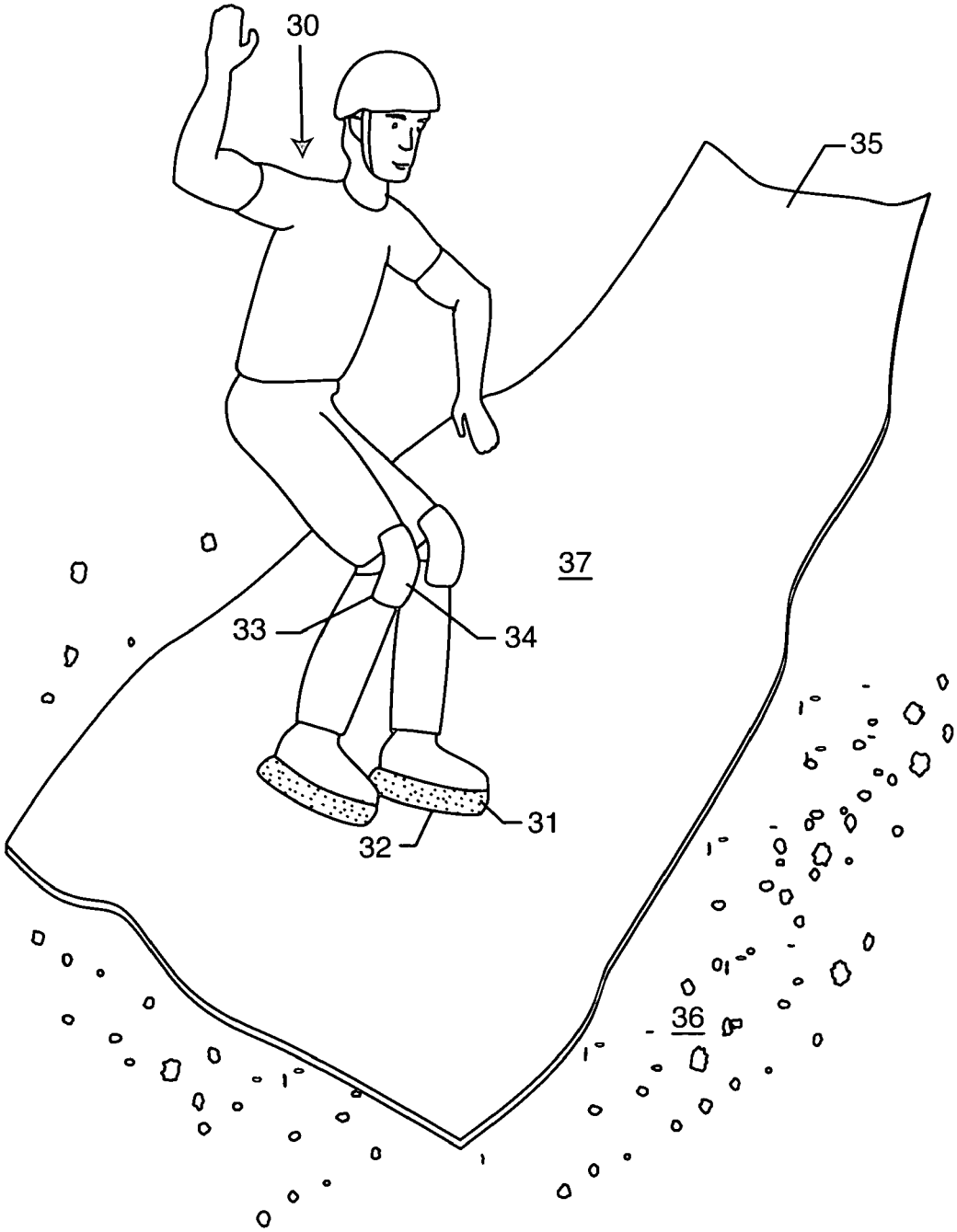
FIG. 3 shows a user traversing a hillside covered with area sheeting according to the invention. Pieces of stick-on sheeting are attached to the user's knee pads and shoe soles.

Referring to FIG. 3, a support structure 36, here a hillside, is covered with area sheeting 37 having a surface 35 composed of a low-friction, durable material. Surface 35 preferably consists essentially of NYLON™, DACRON™, TEXLON™,sailcloth or a polyester resin. The area sheeting 37 can be applied in sheets rolled out onto the support structure. In FIG. 3, the area sheeting 37 is simply applied to an existing sloping hillside converting the hillside into a low-friction sliding area. Area sheeting can be virtually any length and width, and various lengths can be laid end-to-end and side-to-side as shown in my '483 patent. Moreover, area sheeting according to the invention can be laid over any support structure whatsoever including custom made ramps, frames and horizontal surfaces, both indoors and outdoors. As shown in the '483 patent, frames, pillow-like cushions and other expedients can be placed beneath and in conjunction with area sheeting to create bumps, moguls, dips and protrusions increasing the degree of difficulty in traversing the area sheeting.

FIG. 3 further shows a user 30 traversing the area sheeting 37. User 30 is shown wearing knee pads 33 each having a piece of stick-on sheeting 34 adhered thereto. User 30 also wears shoes with soles 31 each having a piece of stick-on sheeting adhered thereto. User 30 could also have one or more pieces of stick-on sheeting adhered to his clothing. Practicing traverses while in the standing position could enhance the ability to balance upon a low-friction surface, thus developing skills which can be applied directly to sports such as snow boarding and surfing.

Figure 4:
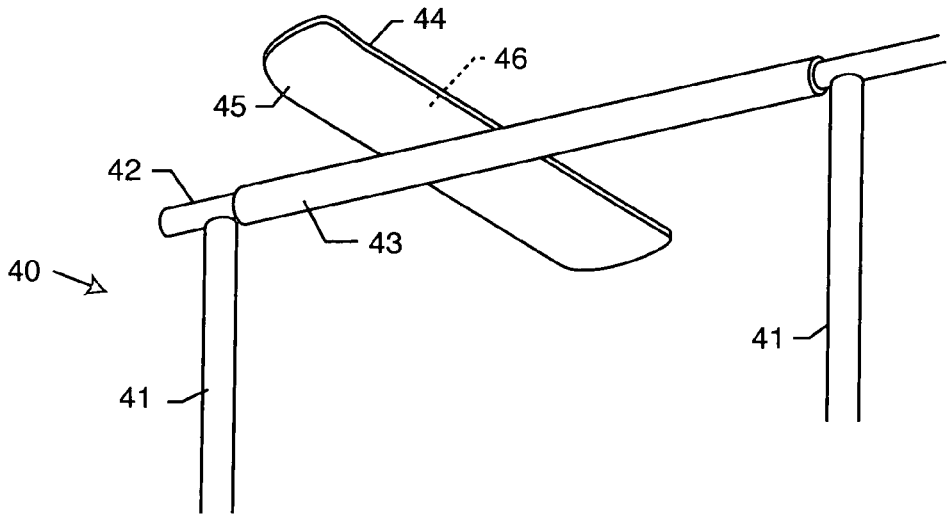
FIG. 4 is a perspective view of a rail wrapped with a length of stick-on sheeting, and a sport board in contact with the rail sheeting.

FIG. 4 shows a handrail assembly 40 such as is commonly installed on a staircase. Assembly 40 includes vertical support members 41 and an inclined handrail 42 whose inclination generally parallels the inclination of the staircase.

It is not uncommon for skateboarders to jump upon a handrail and slide down the rail. A similar effect can be achieved by tightly wrapping handrail 42 with a length of low-friction, durable stick-on sheeting 43. By wrapping either the top surface or the entire surface of handrail 42 with the sheeting 43, handrail 42 can be made selectively into a sliding surface which both protects the handrail from abusive contact with a sliding board and can be converted back into a traditional handrail by removing the sheeting 43 therefrom. In use, board 44, supporting a rider, can be caused to travel along the surface of sheeting 43. To enhance sliding contact, the underside 46 of board 44 has adhered thereto a piece of stick-on sheeting 45 as on the FIG. 1 board.

Figure 5:
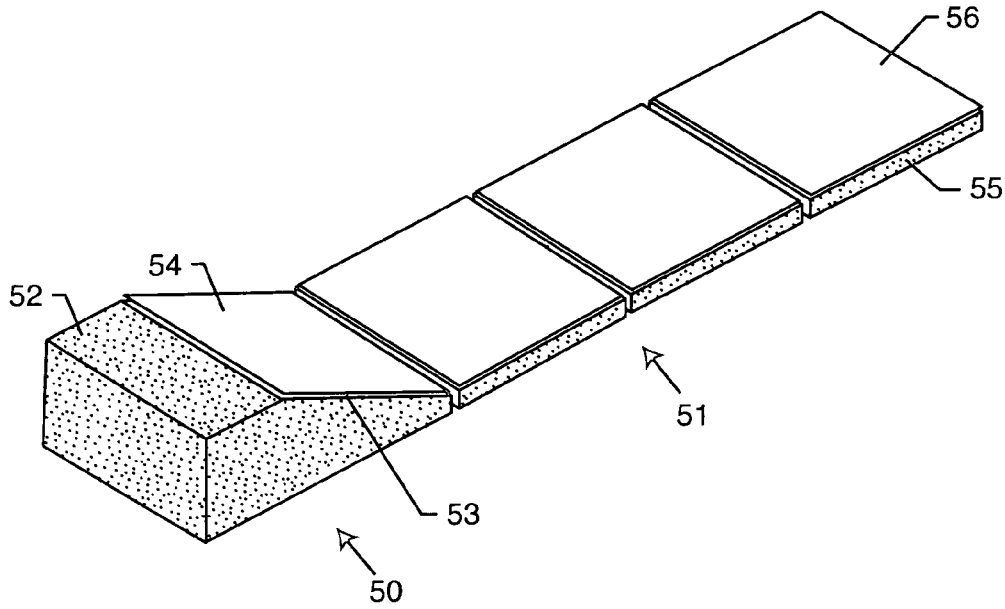
FIG. 5 shows a horizontal platform leading to a ramp and a plurality of generally horizontal, contiguous gym mats. The ramp and mats are covered with area sheeting according to the invention.

FIG. 5 depicts a simplistic but effective means of assembling a recreational device out of parts not intended for that purpose. A ramp 50 has a generally horizontal platform 52 and an inclined surface 53. At the bottom of ramp 50 are placed a plurality of contiguous gym mats 51 each having a body portion 55. Each mat and the inclined surface 53 are covered by low-friction, durable stick-on sheeting 56, 54, respectively. A user stands on platform 52 and, either with or without a board, slides down sheeting 54 on inclined surface 53 and continues sliding along the sheeting 56 on mats 51.

As in all the support structure embodiments disclosed herein, area sheeting such as sheetings 54 and 56 can be applied to an entire surface, or selectively applied to a surface in order to create certain safety characteristics and zones of interest. For example, the edges along inclined surface 53 and mat body portions 55 can be left without sheeting so that as a user progresses too close to an edge, relatively higher friction areas will slow the sliding motion and help prevent the user from falling off the sliding surface. In addition, segments on a sliding surface can be left without stick-on sheeting to provide areas of relatively high friction which enhance the sliding experience. For example, enhanced skill and dexterity can be promoted by encouraging a user to navigate over a surface while avoiding high friction areas in order to increase speed.

Figure 6:
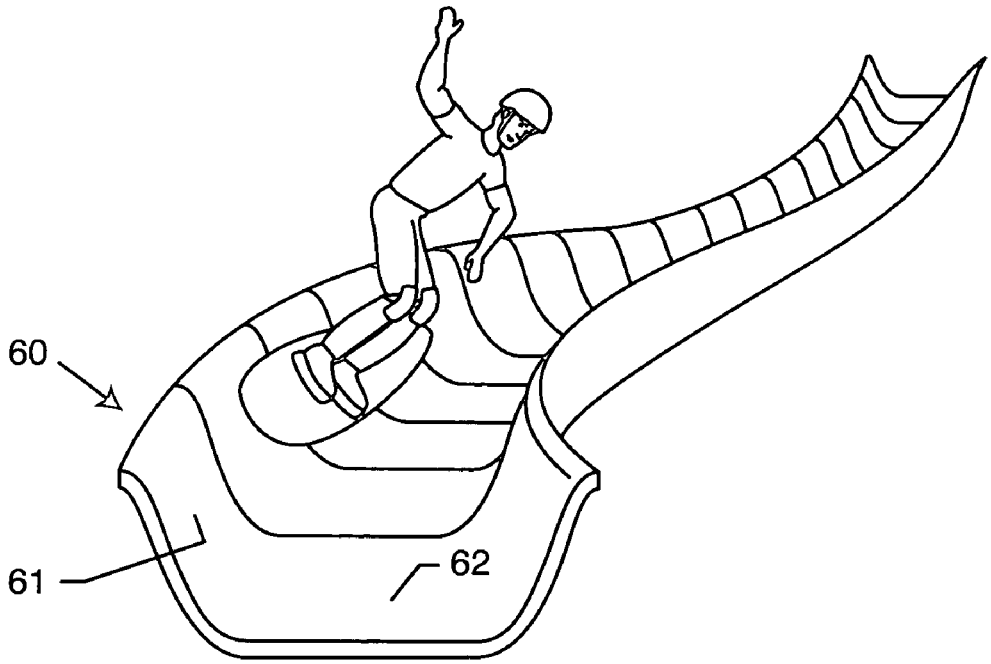
FIG. 6 shows a perspective view of a waterslide modified by applying area sheeting according to the invention.

FIG. 6 illustrates a waterslide 60 with upturned edges 61 which, conventionally, would be traversed by a user riding on a low-friction film created by a continuous stream of water, but which here is modified according to the present invention. Area sheeting 62 provides a low-friction surface obviating the need for water. It is envisioned that a seasonal waterslide park could be converted to an all-season wet and dry facility without necessitating major modifications to the existing equipment.

Figure 7:
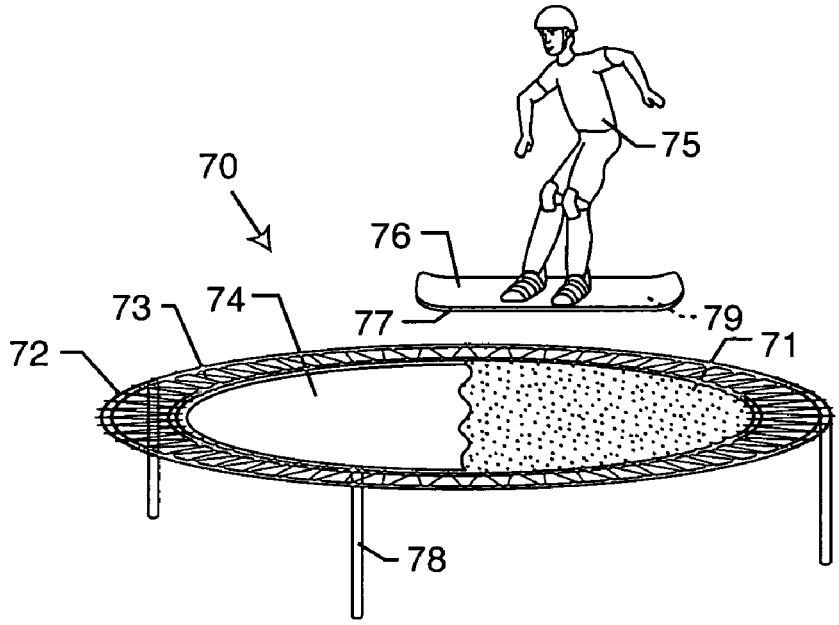
FIG. 7 shows a user on a snow board, to whose underside is attached a piece of stick-on sheeting, bouncing on a trampoline covered with area sheeting superposed on the trampoline fabric.

It is well known that trampolines are used by sport board enthusiasts to practice their jumping skills. FIG. 7 shows an individual 75 on a snow board 76 jumping on a trampoline 70. The trampoline includes a frame 73 mounted on legs 78, and a fabric sheet 71 attached to the frame 73 by a cord 72.

In using trampolines to practice jumping, the somewhat sharp edges of the sport boards are known to excessively abrade the trampoline fabric. To avoid this problem, users often put duct tape over the board edges. This remediation is unsightly and can adversely affect the sensation that a user would otherwise experience.

The present invention, by contrast, employs stick-on sheeting 77 on the underside 79 of board 76, either with or without padding between the board and sheeting. Optionally, low-friction sheeting 74, shown in a partial cutaway view in FIG. 7, can be placed on top of fabric 71. This additional sheeting further acts to protect fabric 71 and changes the coefficient of friction of the trampoline, thereby changing the tactile experience of the user.

Figure 8:
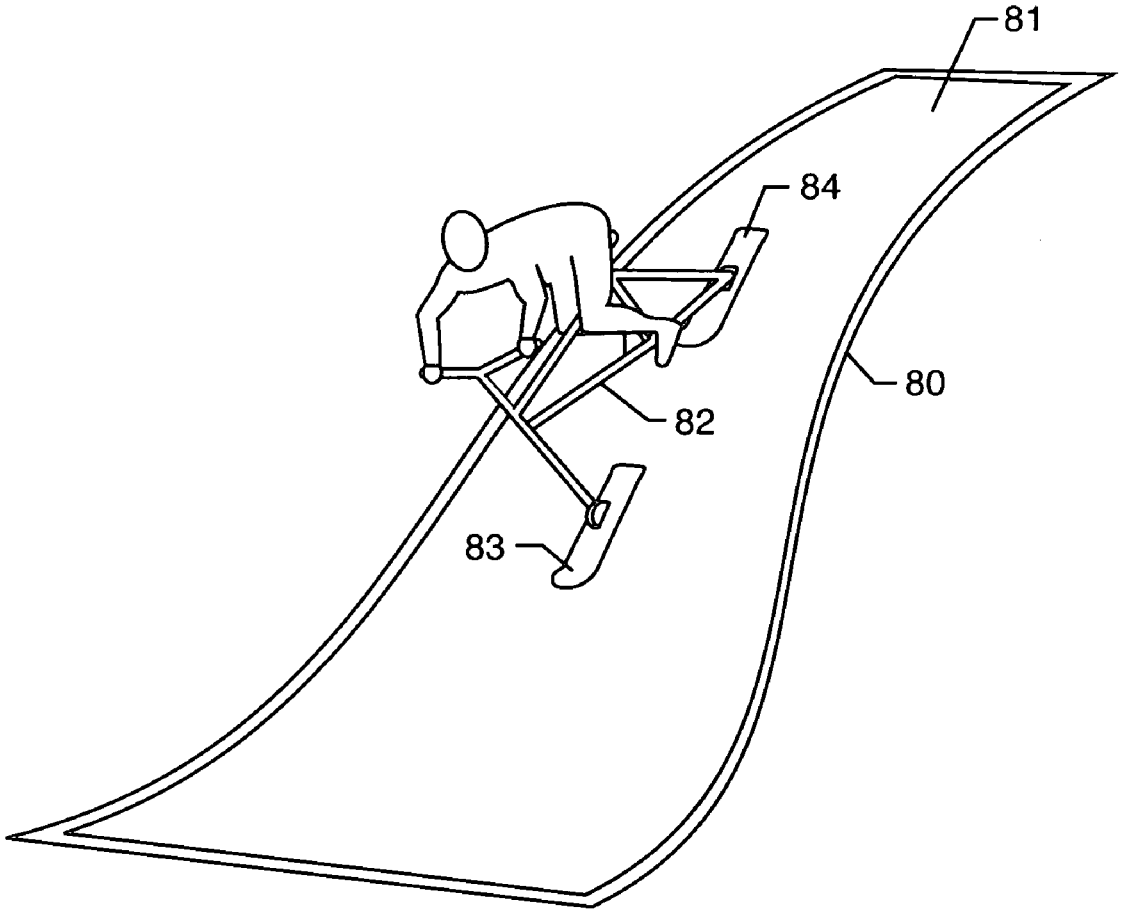
FIG. 8 shows, a ski bicycle to whose runners are attached pieces of stick-on sheeting, traversing an undulating ramp covered with area sheeting.

FIG. 8 depicts a bicycle 82 fitted with ski-like runners 83, 84 for traversing a snow-covered slope. Bicycle 82 is adapted for use on an undulating ramp 80 covered with low-friction area sheeting 81 by adhering pieces of low-friction, durable sheeting (not shown) to the undersides of runners 83, 84.

It is contemplated that the present invention can be used on a multitude of support surfaces, from carpets to concrete, which are horizontal, inclined or declined and have smooth, rough or mogul-like contours. It is further contemplated that the invention can be employed on inflatable support structures, examples of which are shown and described in my '483 patent. Applying strips of stick-on sheeting to inflatable support structures can be particularly advantageous because besides providing a low-friction, durable surface, such strips would serve to protect and, if necessary, repair support surfaces susceptible to tears and punctures. Numerous types of sport boards can be employed such as snow boards, surf boards, skis, skate boards, body boards, sail boards, wake boards, water skis, sleds and the runners of ski bicycles. It is further contemplated that when a support structure such as shown in FIG. 3, 6 or 8 is used, the invention can be practiced in any climatic condition, e.g., on a hill on a rainy or snowy day, or on a wet, converted waterslide.

I claim:

1. A sliding exercise apparatus and recreational device comprising a sports board, being of sufficient size and rigidity to support a user, said sports board having a top for contacting a user and a bottom for sliding along a support surface, said bottom providing a substrate supporting stick-on sheeting material applied thereto, said stick-on sheeting having an adhesive layer for adhering said stick-on sheeting material to said sports board and a low-friction, durable layer for engaging in sliding contact with said support surface, said support surface having applied thereto low-friction, durable sheeting for contacting said stick-on sheeting material, wherein said low-friction, durable sheeting comprises a material selected from the group consisting of nylon, TEXLON™, sailcloth, DACRON™, and polyester resins.

2. The sliding exercise apparatus of claim 1 wherein said sports board is a member selected from the group consisting of snow boards, surfboards, skis, skate boards, body boards, sail boards, wake boards, water skis, sleds and runners applied to the frame of a bicycle.

3. A sliding exercise apparatus and recreational device comprising the combination of a sports board, being of sufficient size and rigidity to support a user, and a support surface, said sports board having a top for contacting a user and a bottom for sliding along the support surface, said bottom being a substrate supporting stick-on sheeting adhered thereto, said stick-on sheeting material having an adhering layer and a low-friction, durable layer for engaging in sliding contact with low-friction, durable sheeting being supported by and in contact with said support surface.

* * * * *